United States Patent [19]

Stoner

[11] 4,258,965

[45] Mar. 31, 1981

[54] ADJUSTABLE ELECTRONIC CIRCUIT CARD SUPPORTER

[75] Inventor: Harry I. Stoner, Aloha, Oreg.

[73] Assignee: The United States of America as represented by the Secretary of the Air Force, Washington, D.C.

[21] Appl. No.: 63,872

[22] Filed: Aug. 3, 1979

[51] Int. Cl.[3] ..... A47B 49/00; A47B 91/00

[52] U.S. Cl. ..... 312/266; 312/24; 312/280

[58] Field of Search ..... 312/208, 266, 280–282, 312/313, 183, 24; 108/97, 99; 248/646; 211/47, 72, 79; 5/429, 430

[56] References Cited

U.S. PATENT DOCUMENTS

| | | | |
|---|---|---|---|
| 1,824,822 | 9/1931 | Kradolfer | 108/97 |
| 1,934,370 | 11/1933 | Mirabella | 312/266 |
| 2,211,199 | 8/1940 | Corken | 312/280 |
| 3,857,623 | 12/1974 | Schneller | 312/266 |

*Primary Examiner*—Casmir A. Nunberg

*Attorney, Agent, or Firm*—Donald J. Singer; Casimer K. Salys

[57] ABSTRACT

An adjustable circuit card support structure having a base support member having a hook flange for supporting the base support member on a cross bar member between circuit card sections of an electronic cabinet. A shelf is secured to the base support member with four link members. An adjustable support arm is pivotably supported on the base support member. A pair of lever members on the adjustable support arm have a center boss shaft pivotably supported between them. A rod member is threaded into the center boss to rotate the support arm around the pivotable support on the base member to raise and lower the shelf member. Two thumb screws permit leveling the base support member. An adjustable extension is provided on the shelf.

2 Claims, 2 Drawing Figures

ADJUSTABLE ELECTRONIC CIRCUIT CARD SUPPORTER

RIGHTS OF THE GOVERNMENT

The invention described herein may be manufactured and used by or for the Government of the United States for all governmental purposes without the payment of any royalty.

BACKGROUND OF THE INVENTION

This invention relates to an adjustable support shelf.

Various types of adjustable supports are known in the art. The U.S. Pat. Nos. to Kradolfer, 1,824,822; Mirabella, 1,934,370; and Kerr, 2,000,336, show adjustable supports.

Electronic Circuit Cards are rather weak structures and need support when pulled out of their section of an electronic cabinet such as when being inspected or during trouble shooting.

Since the cards are fragile and very expensive, some means is needed to provide adequate support for the circuit cards, mounted in a horizontal plane.

BRIEF SUMMARY OF THE INVENTION

According to this invention, an adjustable support structure is provided which can be hooked on cross bars adjacent each circuit card section of an electronic cabinet. The shelf on the support structure is made adjustable so that it can be positioned to receive each of the circuit cards in the section. A shelf extension is provided on the shelf.

IN THE DRAWINGS

DETAILED DESCRIPTION OF THE DRAWING

Figure 1:
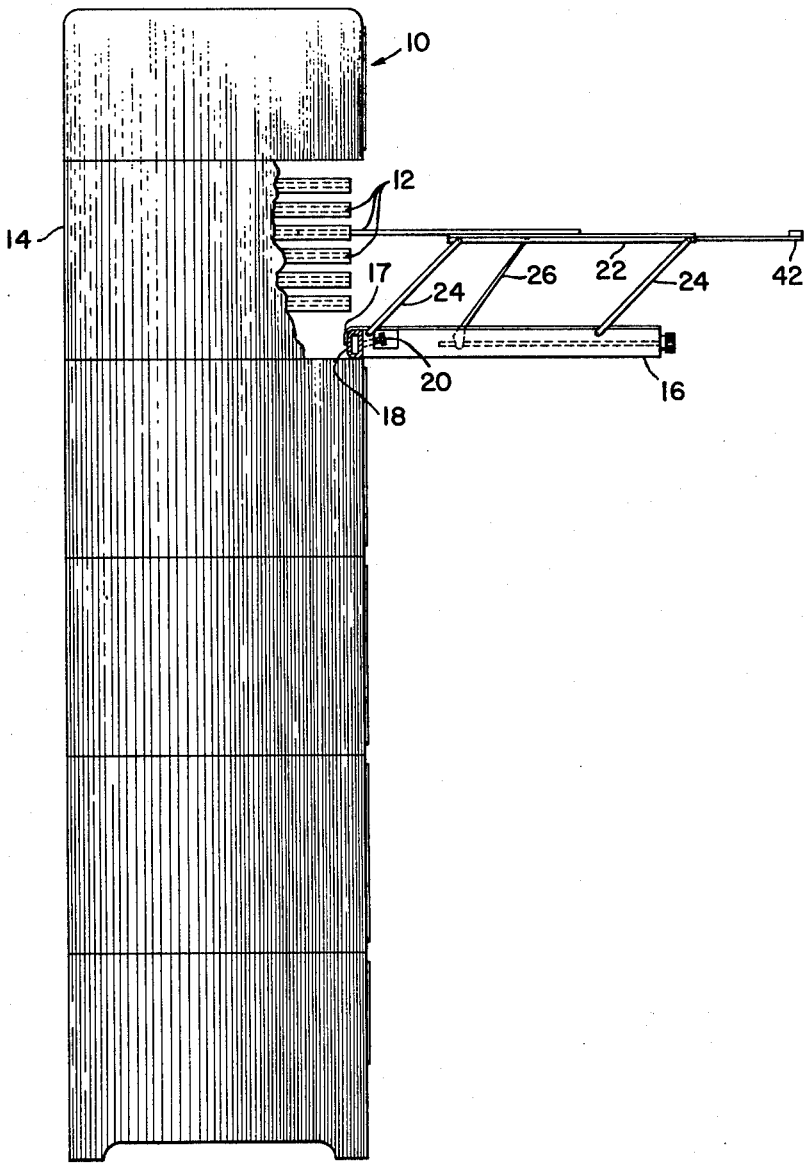
FIG. 1 is a partially schematic view of an adjustable support device attached to one section of an electronic cabinet.

Reference is now made to FIG. 1 of the drawing which shows a conventional electronic cabinet 10 including a plurality of electronic circuit cards 12 stored in card sections 14.

Figure 2:
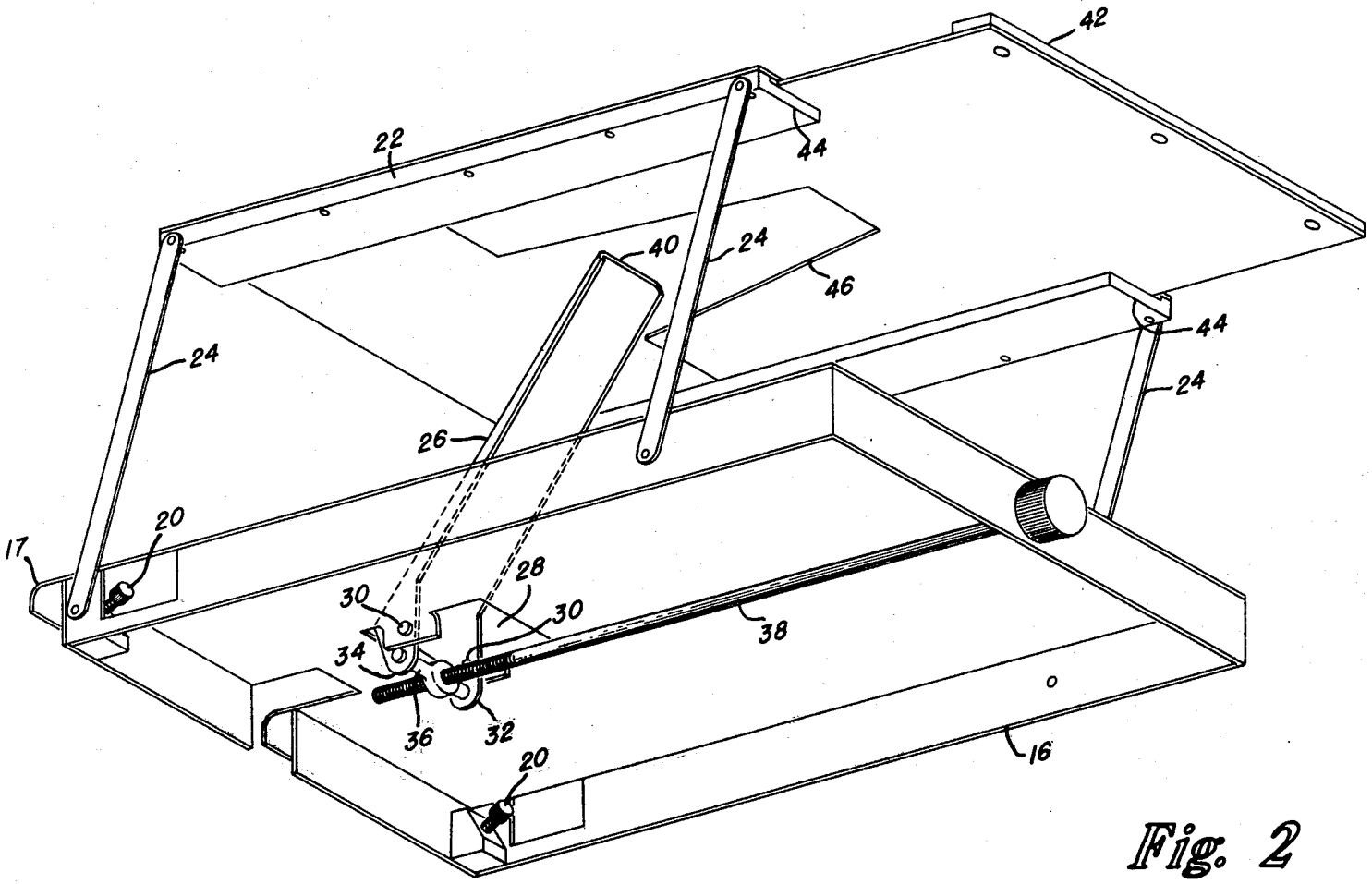
FIG. 2 is a partially schematic isometric view of the adjustable support device of FIG. 1.

To provide support for circuit cards withdrawn from the cabinet for inspection or repair, a base support member 16 has a hook flange 17, shown in greater detail in FIG. 2, which is adapted to hook over a cross bar member 18 on the cabinet 10. One cross bar member is located near the front of the cabinet between adjacent circuit card sections. Thumb screws 20, on the base support member, engage the cross bar member and are used to level the base support member.

A circuit card support shelf 22 is secured to the base support member 16 by four link members 24. This shelf

22 should be made of a non-conductive material, such as plastic.

A shelf support arm 26 is pivotably supported on the base support member 16, in a recess 28, by means of pivot pins 30. A pair of lever members 32 and 34 on shelf support arm 26 engage the ends of a pivot boss shaft 36. A rod 38 is threaded into the boss on shaft 36 so that rotation of rod 38 acts to pivot arm 26 around pivot pins 30. The end 40 of arm 26 engages the bottom of shaft 22 to raise and lower the shelf when rod 38 is rotated.

A shelf extension 42 is supported on support rails 44 secured to the shelf 22. The shelf extension 42 has a notch 46 to permit the end 40 of arm 26 to engage the bottom of the shelf when extension 42 is in its extended position. When the shelf is at rest on support member 16, the end 40 of arm 26 is spaced from the bottom of shelf 22 to permit movement of shelf extension 42 to its retracted position.

In the operation of the device, the hook flange 17 is placed over the bar member 18 below the section containing the particular circuit card or cards which are to be inspected or repaired. The leveling thumb screws 20 are adjusted to level the support member 16. The shelf extension is then extended and the rod 38 is rotated to raise the shelf 22 to the desired level. The circuit card at that level can then be withdrawn from the cabinet 10, onto shelf 22, for inspection or repair. After the circuit card is returned to the cabinet, the shelf can be adjusted to other levels to permit the removal of other circuit cards in the same section or the device can be moved to other sections with the hook flange 17 being hooked over another bar member 18.

There is thus provided an electronic circuit card support member which can be supported adjacent any section in an electronic cabinet with an adjustable support shelf capable of being positioned to provide support for any circuit card in the section.

I claim:

1. An adjustable circuit card support structure adapted to be supported on an electronic cabinet having a plurality of stacked circuit card sections with a cross bar member adjacent the front of the cabinet between each of the sections, comprising: a base support member; a means for leveling the base support member; a means for securing the base support member on one of said cross bar members; a shelf member secured to said base support member; a plurality of link members secured to said base support member and said shelf member; and a lever arm pivotably supported on said base support member having a means for rotating the lever arm around said pivotable support to raise and lower the shelf.

2. The device as recited in claim 1 including a shelf extension slidably supported on said shelf.

* * * * *